US009945061B2

(12) United States Patent
Vaive

(10) Patent No.: US 9,945,061 B2
(45) Date of Patent: Apr. 17, 2018

(54) LAUNDRY TREATING APPLIANCE HAVING A ROTATABLE BLADE FOR LIQUID EXTRACTION

(71) Applicant: WHIRLPOOL CORPORATION, Benton Harbor, MI (US)

(72) Inventor: Nicholas Vaive, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 170 days.

(21) Appl. No.: 14/885,211

(22) Filed: Oct. 16, 2015

(65) Prior Publication Data

US 2017/0107654 A1 Apr. 20, 2017

(51) Int. Cl.

| | |
|---|---|
| ***D06F 23/04*** | (2006.01) |
| ***D06F 27/00*** | (2006.01) |
| ***D06F 33/00*** | (2006.01) |
| ***D06F 35/00*** | (2006.01) |
| ***D06F 37/30*** | (2006.01) |
| ***D06F 37/40*** | (2006.01) |
| ***D06F 37/02*** | (2006.01) |
| *D06F 33/02* | (2006.01) |

(52) U.S. Cl.

CPC ..... *D06F 23/04* (2013.01); *D06F 27/00* (2013.01); *D06F 33/00* (2013.01); *D06F 35/007* (2013.01); *D06F 37/02* (2013.01); *D06F 37/302* (2013.01); *D06F 37/304* (2013.01); *D06F 37/40* (2013.01); *D06F 33/02* (2013.01); *D06F 2232/08* (2013.01); *D06F 2700/05* (2013.01)

(58) Field of Classification Search

CPC ..... D06F 23/04; D06F 27/00; D06F 33/00; D06F 35/007; D06F 67/302; D06F 37/304; D06F 37/40; D06F 2232/08; D06F 2700/05

USPC ..... 68/23 R, 23.6, 23.7, 142

See application file for complete search history.

(56) References Cited

U.S. PATENT DOCUMENTS

| | | | | |
|---|---|---|---|---|
| 5,249,441 | A | 10/1993 | Pastryk et al. | |
| 7,926,138 | B2 | 4/2011 | Lee | |
| 8,573,009 | B2 | 11/2013 | Ekbundit et al. | |
| 2003/0196459 | A1* | 10/2003 | Ions | D06F 37/04 68/12.14 |
| 2006/0081014 | A1 | 4/2006 | Choi et al. | |
| 2007/0028654 | A1 | 2/2007 | Choi et al. | |
| 2013/0036774 | A1 | 2/2013 | Kim et al. | |
| 2013/0042656 | A1* | 2/2013 | Ekbundit | D06F 37/14 68/5 C |
| 2014/0189961 | A1* | 7/2014 | He | D06F 35/00 8/137 |

FOREIGN PATENT DOCUMENTS

| | | | |
|---|---|---|---|
| DE | 19961462 | A1 | 6/2001 |
| EP | 2471989 | A1 | 7/2012 |

* cited by examiner

*Primary Examiner* — Michael E Barr
*Assistant Examiner* — Levon J Shahinian

(57) ABSTRACT

A laundry treating appliance for treating laundry according to an automatic cycle of operation, comprising a basket defining a treating chamber for receiving laundry to be washed. The basket has multiple perforations through which liquid may pass. A blade can be rotated about the exterior of the basket creating a suction force acting on the perforations to draw liquid from the treating chamber through the perforations.

19 Claims, 5 Drawing Sheets

LAUNDRY TREATING APPLIANCE HAVING A ROTATABLE BLADE FOR LIQUID EXTRACTION

BACKGROUND

Contemporary laundry treating appliances include vertical axis washing machines having a tub, a basket within the tub defining a treating chamber for the laundry. The tub and basket have aligned top openings that provide access to the treating chamber. In current implementations, the basket has perforations and is rotated at a sufficient speed to extract liquid from the laundry centrifugal force, which also causes water to exit the perforations.

BRIEF DESCRIPTION OF THE INVENTION

In one aspect, illustrative embodiments in accordance with the present disclosure relate to a laundry treating appliance for treating laundry according to an automatic cycle of operation, comprising a basket defining a treating chamber for receiving laundry to be washed and having an inner wall and an outer wall, at least one of the inner and outer walls having perforations, and the inner and outer walls being movable relative to each other between first and second positions to selectively open and close the perforations. A blade rotatable outside the exterior of the outer wall can rotate about the outer wall, when the inner and outer walls are in the first position, creating a suction force acting on the perforations to draw liquid from the treating chamber through the perforations.

In another aspect, the illustrative embodiments in accordance with the present disclosure relate to a laundry treating appliance for treating laundry according to an automatic cycle of operation, comprising a basket defining a treating chamber for receiving laundry to be washed and having a wall with a plurality of perforations including at least one blade rotatable outside of the exterior of the wall, wherein rotation of the blade about the wall creates a suction force acting on the perforations to draw liquid from the treating chamber through the perforations.

DESCRIPTION OF EMBODIMENTS OF THE INVENTION

Figure 1:
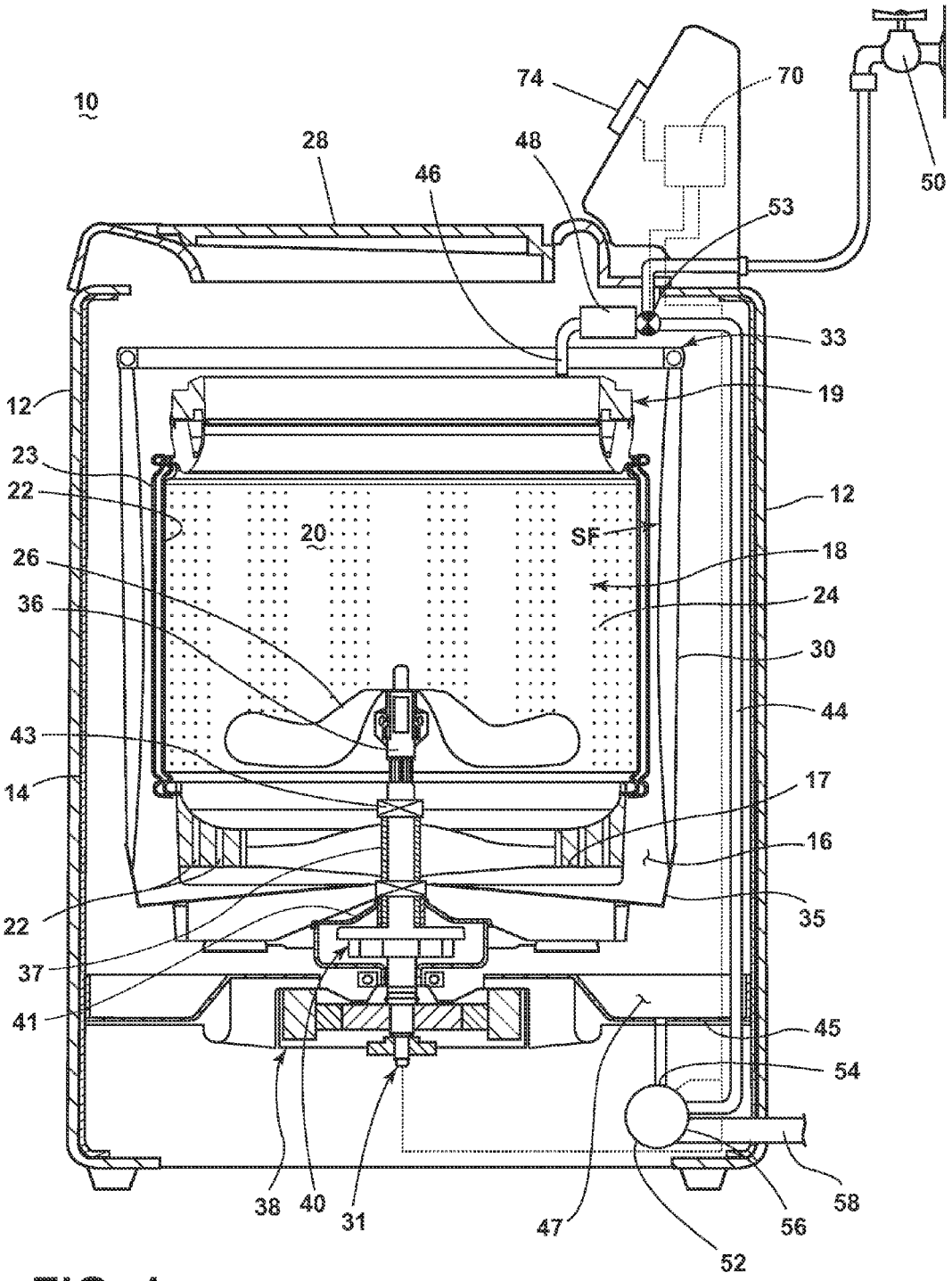
FIG. 1 is a schematic view of a vertical axis washing machine incorporating a first embodiment of the invention having a rotatable basket and a rotatable blade.

FIG. 1 is a schematic view of a laundry treating appliance according to an exemplary embodiment having an automatic cycle of operation. While the laundry treating appliance 10 has been illustrated as a vertical axis, top-fill washing machine, embodiments of the invention can have applicability in other laundry treating appliances including by way of non-limiting example a combination laundry washing and drying machine, a non-aqueous laundry treating appliance, etc. The cabinet 12 can be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The washing machine 10 can include a housing or cabinet 12 and a static wash tub 14, which can be in a fixed position with respect to the cabinet 12. It will be understood that the cabinet 12 can be a frame or chassis with or without panels attached. By "static wash tub," it is not necessarily meant that the wash tub 14 is fixedly integrated to the cabinet 12 as shown in FIG. 1. The wash tub 14 can be referred to as the static wash tub as long as the wash tub 14 can be in a fixed position with respect to the cabinet 12. For example, the static wash tub 14 can be spaced from the cabinet 12 by a predetermined distance. The static wash tub 14 can define an interior 16 within which a rotatable drum or wash basket 18 can be mounted for rotation about a vertical axis.

The wash basket 18 can define a treating chamber 20 for receiving a laundry load. The wash basket 18 can include a base portion 17 having one or more drain holes 21 to discharge the liquid from the wash basket 18. The wash basket 18 can have a generally cylindrical side formed by an inner wall 22 and an outer wall 23. At least one of the inner and outer walls 22, 23 can include a plurality of perforations 24. The inner and outer walls 22, 23 are relatively moveable such that their movement opens/closes the perforations 24.

A clothes mover or impeller 26 can be located within the treating chamber 20 and rotatable relative to and/or with the wash basket 18. For example, the impeller 26 can be oscillated or rotated about its axis of rotation during a cycle of operation in order to provide movement to the fabric load contained within the treating chamber 20. A balance ring 19 can be coupled to a top portion of the wash basket 18 for offsetting an imbalance from the rotation of laundry items that are non-uniformly distributed in the wash basket 18.

The top of the cabinet 12 can include a selectively openable lid 28 to provide access into the treating chamber 20 through the open top of the wash basket 18.

A blade assembly 33 is provide about the exterior of the wash basket 18. The blade assembly 32 comprises upper and lower supports 34, 35 between which extends at least one blade 30. The blade assembly 32 is configured such that the blade 30 rotates about the wash basket 18 by either rotating the blade assembly 32 about the wash basket 18 or rotating the blade 30 relative to the blade assembly 32 and wash basket 18.

As illustrated, the blade assembly 32 is located within the interior 16 between the outer wall 23 and the wash tub 14 spaced from the outer wall 23. The blade assembly 32 may have multiple blades 30. The rotation of the blades create a suction force SF on the exterior of the wash basket which acts on the perforations 24 to draw liquid from the treating chamber 20 through the perforations 24.

A drivetrain 31 comprising a motor 38 with an output shaft 36 coupled to a transmission 40 can be provided to drive the blade assembly 32, the wash basket 18, and the impeller 26. The transmission 40 can further include a first clutch 42 selectively coupling the output shaft 36 to a first drive tube 41 connected to the blade assembly 32, and a second clutch 43 selectively coupling the output shaft 36 to a second drive tube 37, while the output shaft 36 directly couples to the impeller 26. With this configuration, the transmission can be operated to selectively couple the blade assembly 32 and wash basket 18 to the rotating output shaft 36 to effect the independent or simultaneous rotation of any of the blade assembly 32, wash basket 18, and impeller 26. The clutches 42, 43 may also include gearboxes for altering the rotational speed and/or direction such that any of the blade assembly 32, wash basket 18, and impeller 26 can be rotated in any combination of speeds and directions, specifically including rotating the blade assembly 32 and wash basket 18 in opposite directions.

Alternative motor assemblies with differing configurations than illustrated in the drawings can be used. For example, a direct drive motor with an exterior rotor and an interior stator can be used with or without a transmission, based upon clearance requirements beneath the motor assembly. The illustrated drivetrain 31 for the blade 30, the wash basket 18, and the impeller 26 is provided for exemplary purposes only and is not limited to that shown in the drawings and described above.

A catch basin 45 can be positioned in the lower portion of the cabinet 12 and can have walls for accommodating a predetermined amount of wash liquid draining from the wash basket 18. The catch basin 45 can form a sump 47 and can be provided with a liquid level sensor for determining the liquid height in the catch basin 45. The catch basin 45 can also be provided with a turbidity sensor for determining the turbidity of the wash liquid received in the catch basin 45. The catch basin 45 works in combination with the static wash tub 14. Embodiments of the invention may be implemented in a non-static tub configuration, where a traditional suspended tub is used instead of the static tub and catch basin 45.

A dispensing system can be provided to the washing machine 10 for supplying treating chemistry to the treating chamber 20 according to a cycle of operation. The dispensing system can include a detergent dispenser 48, which can be a single use dispenser, a bulk dispenser or a combination of a single use and bulk dispenser. As illustrated in FIG. 1, the detergent dispenser 48 can be positioned within the static wash tub 14, and can be disposed vertically above the catch basin 45 for providing one or more treating chemistries to the catch basin 45 by gravity according to a cycle of operation. The detergent dispenser 48 can include a conduit with a predetermined dimension for guiding the supply of one or more treating chemistries to the catch basin 45. The treating chemistries can be in the form of at least one of liquid, powder, pod, compressed puck, or combination thereof.

The treating chemistries can be provided without being mixed with wash liquid from the recirculation conduit 44 or water from the household water supply 50. In another embodiment, the detergent dispenser 48 can be operably configured to dispense a treating chemistry mixed with water supplied from the household water supply 50 through the sprayer 46. The sprayer 46 can be configured to dispense the treating chemistry into the treating chamber 20 in a desired pattern and under a desired amount of pressure. For example, the sprayer 46 can be configured to dispense a flow or stream of treating chemistry into the wash tub 14 by gravity, i.e. a non-pressurized stream. Non-limiting examples of treating chemistries that can be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

A recirculation and drain system can be provided to the laundry treating appliance 10 for recirculating liquid within and/or draining liquid from the laundry treating appliance 10. A pump 52 can have an inlet 54 fluidly coupled to the sump 47 and an outlet 56 configured to fluidly couple to the recirculation conduit 44 and a drain conduit 58. It can be understood that the pump 52 can be configured to switch the pumping direction by operating the motor coupled to the pump 52 in the reverse direction. Alternatively, two separate pumps, such as a recirculation pump and a drain pump, can be used instead of the single pump.

Additionally, the spraying system, the dispensing system, and the recirculation and drain system can differ from the configuration shown in FIG. 1, such as by inclusion of other valves, conduits, treating chemistry dispensers, sensors and the like, to control the flow of liquid through the washing machine 10 and for the introduction of more than one type of treating chemistries.

Figure 2:
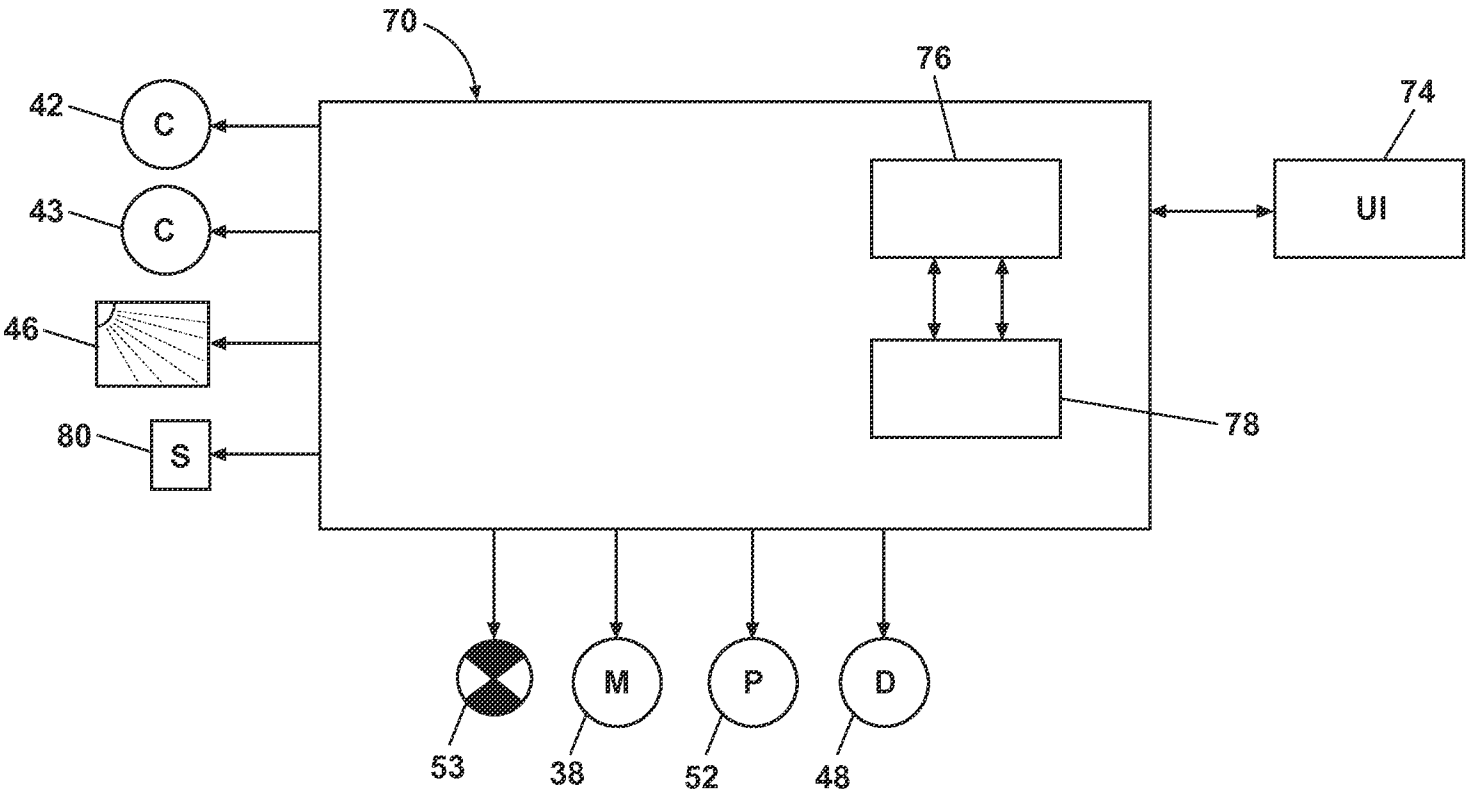
FIG. 2 is a schematic of a control system for the washing machine of FIG. 1.

As illustrated in FIG. 2, a user interface 74 can be coupled to a controller 70, which can be provided with a memory 76 and a central processing unit (CPU) 78. The memory 76 can be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the washing machine 10 that can be communicably coupled with the controller 70. The database or table can be used to store the various operating parameters for the one or more cycles of operation, including factory default values for the operating parameters and any adjustments to them by the control system or by user input. Such information or operating parameters stored in the memory 76 can also include acceleration ramps, threshold values, predetermined criteria, etc.

The controller 70 can be operably coupled with one or more components of the washing machine 10 for communicating with and controlling the operation of the component to complete a cycle of operation. For example, the controller 70 can be operably coupled with the motor 38, clutches 42, 43, valve assembly 53, the pump 52, the dispenser 48, and any other additional components that can be present such as a steam generator and/or a sump heater (not shown) to control the operation of these and other components to implement one or more of the cycles of operation. The controller 70 can also be coupled with one or more sensors 80 provided in one or more of the systems of the washing machine 10 to receive input from the sensors, which are known in the art and not shown for simplicity. Such sensors 80 can include a motor torque sensor, a speed sensor, an acceleration sensor, and/or a position sensor providing an output or signal indicative of the torque applied by the motor 38, a speed of the wash basket 18 or component of the drivetrain 31, an acceleration of the wash basket 18 or component of the drivetrain 31, and a position sensor of the wash basket 18.

Figure 3:
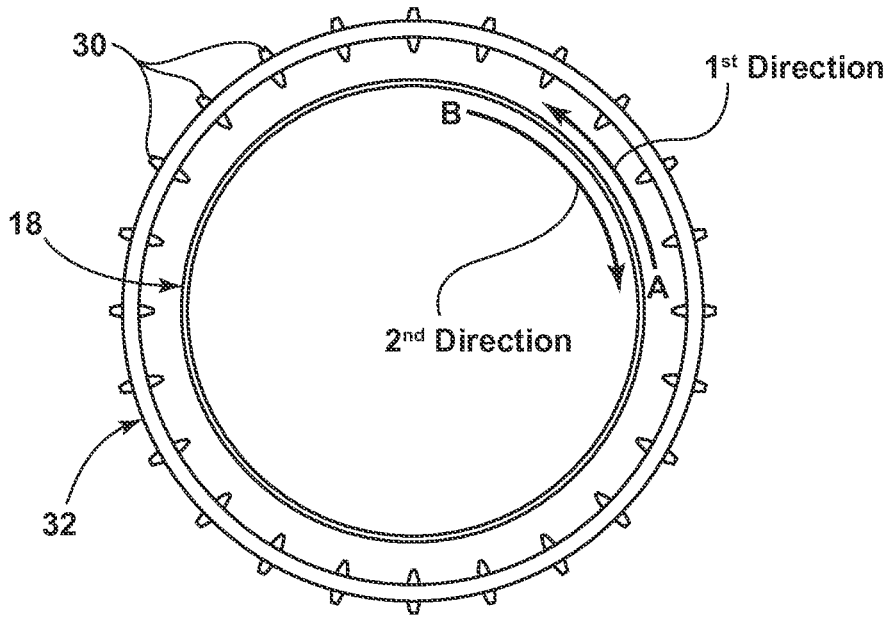
FIG. 3 is a schematic of a top view of the washing machine in motion, with the basket and blade rotating in opposite directions.

Referring now to FIG. 3, the drivetrain 31 can rotate the blade 30 in a first direction illustrated by arrow A. The motor can rotate the blade 30 at various speeds in order to extract liquid from the wash basket 18 by way of the suction force SF acting on the perforations 24. It is contemplated that the blade 30 will be close to the wash basket 18, but not touch the wash basket 18. While the blade 30 can touch the wash basket 18, and it would enhance the suction force SF, the touching of the blade 30 to the wash basket 18 will generate friction and require a larger motor, which is not desirable, but is possible.

The suction force SF can be enhanced by counter rotating the wash basket 18 and the blade 30. The counter rotation results in a substantial increase in the relative difference in rotational speed between the wash basket 18 and blade 30. The rotational speed of the wash basket 18 and blade 30 need not be of the same magnitude when counter rotating. Output limits of the motor 38 will likely limit the rotational speeds. As it is contemplated that the inertia of the wash basket 18 will be greater than the inertia of the blade, it is contemplated that, if the wash basket 18 and blade 30 are rotated at different magnitudes, then the blade will be rotated at the greater magnitude.

Whether the blade 30 is rotated alone or counter-rotated with the wash basket 18, the controller 70 controls the rotation. The controller 70 can selectively actuate the clutches 42, 43 and their corresponding gear boxes, if any, to control the magnitude and direction of rotation for each of the wash basket 18 and blade 30. In the exemplary embodiment, the speed at which the wash basket 18 rotates is less than a speed where the centrifugal force acting at the inner wall of the wash basket 18 is less than the force of gravity. The speed at which the blade 30 is rotated is greater than the speed at which the wash basket 18 is rotated.

The controller 70 can co-rotate the wash basket 18 and blade 30 in the same direction. As such co-rotation would reduce the magnitude of the resulting suction force SF, co-rotation is not likely to be selected. However, there may be circumstances where co-rotation is beneficial.

Figure 4:
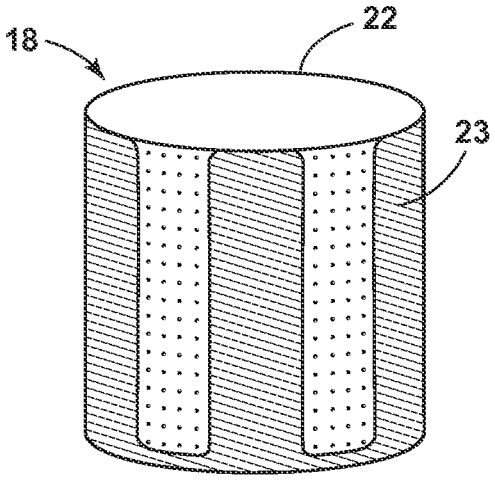
FIG. 4 is a perspective view of a basket for the washing machine of FIG. 1, with the basket having dual walls, which are relatively rotatable to open perforations in one of the walls in a first position.
Figure 5:
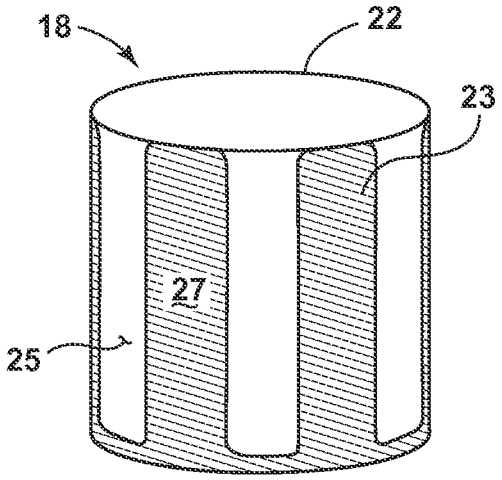
FIG. 5 is a perspective view of the basket for the washing machine in a second position where the dual walls are relatively rotated to close the perforations.

Referring now to FIGS. 4 and 5, an exemplary embodiment of the wash basket 18 and the inner and outer walls 22, 23 are shown in a first position (FIG. 4) and a second position (FIG. 5). The inner and outer walls 22, 23 are movable relative to each other between the first and the second position to selectively open and close the perforations 24 such that liquid supplied to the wash basket 18 can flow through the perforations 24 to the wash tub 14. The inner and outer walls 22, 23 can be connected, such as along their bottoms, by a lost motion device, such as a tab on one of the walls 22, 23 located with a partial space in the other of the walls 22, 23, that provides for the rotation of the one of the walls 22, 23 relative to the other, until they both start to rotate together. Thus, by rotation the second drive tube 37 in one direction, one of the walls 22, 23 will rotate through a first rotational angle before both walls 22, 23 start to rotate together. The reversal of rotational direction will result in the other of the walls 22, 23 rotating in the other direction through the first rotational angle, until they both start to rotate together.

With this configuration, the drivetrain 31 can move the inner and outer walls into the first position (FIG. 4) in response to the motion of the wash basket 18 in the second direction. In the same way, when the clutch is engaged to operate the wash basket 18 in the first direction, the drivetrain 31 can move the inner and outer walls into the second position (FIG. 5). As can be seen in FIG. 4, in the first position, the perforations 24 are uncovered or in an open condition, whereas in FIG. 5, the perforations 24 are covered and in a closed condition.

To aid in the opening and closing of the perforations 24, the perforations 24 can be arranged on the inner wall 22 in a predetermined arrangement, and the outer wall 23 can have open areas 25 corresponding to the predetermined arrangement. As illustrated, the predetermined arrangement of the perforations are columns of perforations 24 and the outer wall 23 has corresponding columns 27. Thus, the relative rotation of the inner/outer walls 22/23 results in the opening/closing of the perforations.

Figure 6:
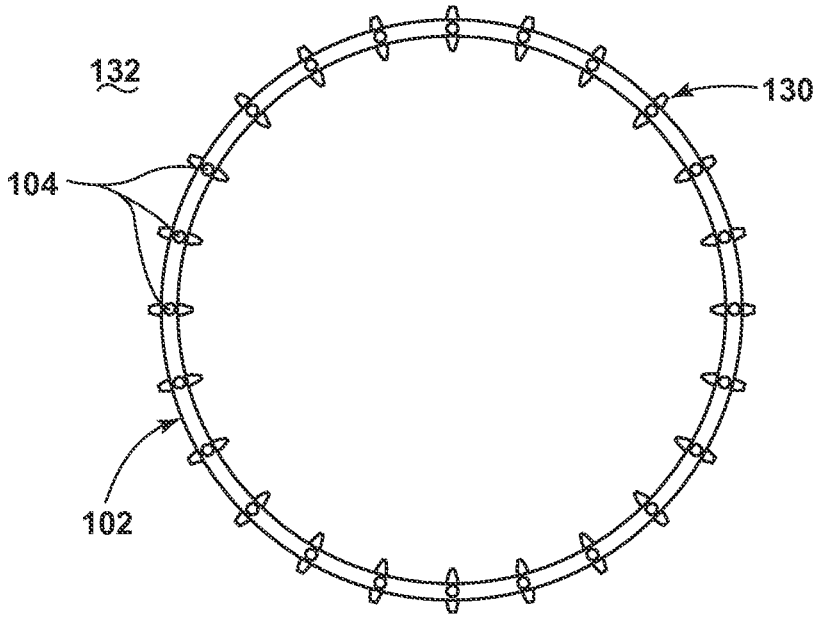
FIG. 6 is a top view diagram of a second embodiment of the invention.

Referring to FIG. 6, a second embodiment of the blade assembly is shown. The blade assembly 132 is illustrated as a track 102 having a plurality of a reduced friction elements such as a ball bearing 104 to which a blade 130 can be coupled and allowed to move freely in the first direction. In this embodiment the blades 130 move freely in the first direction while the track 102 remains stationary.

Figure 7:
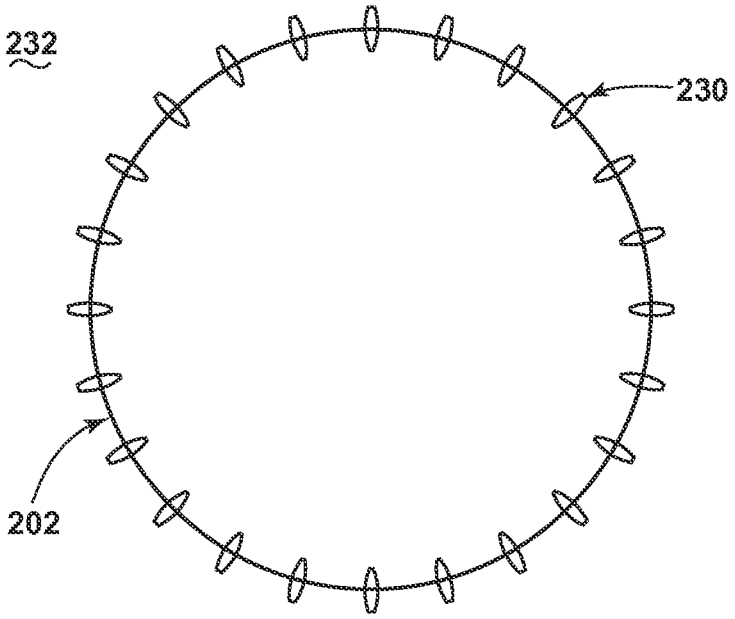
FIG. 7 is a top view diagram of a third embodiment of the invention.

Referring to FIG. 7, a third embodiment of the blade assembly is shown. The blade assembly 232 is illustrated as a track 202 having a fixed component to which a blade 230 is coupled. In this embodiment the entire track 202 moves in a first direction causing the blades to also move in the first direction.

Figure 8:
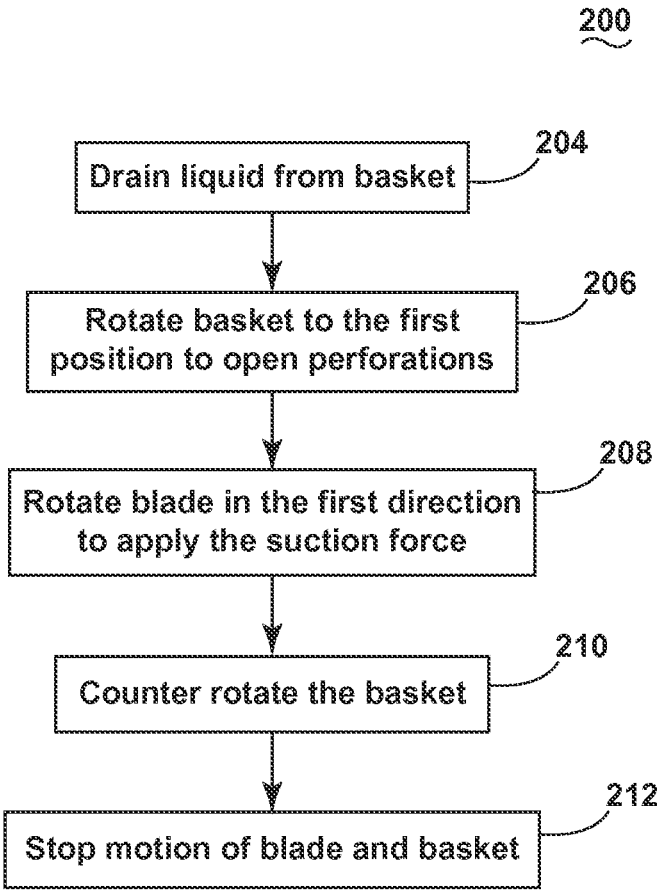
FIG. 8 is a flow chart showing an embodiment of a method for extracting liquid from a washing machine.

FIG. 8 illustrates a method of extracting liquid from laundry 200 within a perforated wash basket 18 in a laundry treating appliance. After draining 204, the wash basket 18 is rotated to the first position 206. The method comprises applying a suction force 208 against an exterior of the wash basket 18 by rotating a blade 30 about the exterior of the wash basket 18 in which applying the suction force SF further comprises counter-rotating 216 the wash basket 18 and the blade 30. Upon completion of the water extraction the motion of the blade and wash basket are stopped 212. When the blade 30 and wash basket 18 are in motion, the blade 30 is rotated at speed greater than the wash basket 18 and the wash basket 18 is rotated at a speed less than a speed where the centrifugal force acting at the wall of the wash basket 18 is less than the force of gravity.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance for treating laundry according to an automatic cycle of operation, comprising:

a basket defining a treating chamber for receiving laundry to be washed and having an inner wall and an outer wall, at least one of the inner and outer walls having perforations, and the inner and outer walls being movable relative to each other between first and second positions to selectively open and close at least some of the perforations; and at least one blade immediately adjacent an exterior of the outer wall and rotatable about and independently with respect to the exterior of the outer wall to generate a suction force on the exterior of the outer wall which acts on the perforations to draw liquid from the treating chamber through the perforations.

2. The laundry treating appliance of claim 1 further comprising a drivetrain operably coupled to the at least one blade to rotate the at least one blade in a first direction.

3. The laundry treating appliance of claim 2 wherein the drivetrain is operably coupled to the basket and rotates the basket in a second direction, opposite the first direction.

4. The laundry treating appliance of claim 3 wherein the drivetrain is operably coupled to the basket to move the inner and outer walls into the first position in response to rotation in the second direction.

5. The laundry treating appliance of claim 4 wherein the drivetrain is operably coupled to the basket to move the inner and outer walls into the second position in response to rotation in the first direction.

6. The laundry treating appliance of claim 5 further comprising a clothes mover located within the treating chamber.

7. The laundry treating appliance of claim 6 wherein the drivetrain is operably coupled to the clothes mover to reciprocally rotate the clothes mover between the first and second directions.

8. The laundry treating appliance of claim 1 further comprising a clothes mover located within the treating chamber.

9. The laundry treating appliance of claim 8 wherein a drivetrain is operably coupled to the clothes mover to reciprocally rotate the clothes mover.

10. The laundry treating appliance of claim 1 wherein the at least one blade comprises multiple blades.

11. The laundry treating appliance of claim 1 wherein the at least one blade is spaced from the outer wall.

12. The laundry treating appliance of claim 1 wherein the at least one blade rotates at a speed, when the inner and outer walls are in the first position, to create the suction force.

13. A laundry treating appliance for treating laundry according to an automatic cycle of operation, comprising:

a basket defining a treating chamber for receiving laundry to be washed and having a wall with a plurality of perforations and defining an exterior; and at least one blade immediately adjacent the exterior and rotatable about and independently with respect to the exterior of the wall to generate a suction force on the exterior which acts on the perforations to draw liquid from the treating chamber through the perforations.

14. The laundry treating appliance of claim 13 further comprising a tub defining an interior and at least one of the basket and blade are located within the interior.

15. The laundry treating appliance of claim 13 further comprising a drivetrain operably coupling at least one of:

a) the at least one blade to rotate the at least one blade in a first direction;

b) the basket and rotates the basket in a second direction, opposite the first direction;

c) the basket to an inner and an outer wall to move the inner and outer walls into a first position in response to rotation in the second direction; and d) the basket to inner and outer walls to move the inner and outer walls into a second position in response to rotation in the first direction.

16. The laundry treating appliance of claim 13 further comprising a clothes mover located within the treating chamber.

17. The laundry treating appliance of claim 13 wherein the at least one blade comprises multiple blades.

18. The laundry treating appliance of claim 17 wherein the at least one blade is spaced from the exterior of the wall.

19. The laundry treating appliance of claim 13 wherein rotation of the at least one blade about the exterior of the wall creates the suction force.

* * * * *